US009353558B2

(12) United States Patent
Hatton

(10) Patent No.: US 9,353,558 B2
(45) Date of Patent: May 31, 2016

(54) CASE LATCH ASSEMBLY

(71) Applicant: Penn Elcom Limited, East Sussex (GB)

(72) Inventor: James Hatton, Sussex (GB)

(73) Assignee: PENN ELCOM LIMITED, East Sussex (GB)

( * ) Notice: Subject to any disclaimer, the term of this patent is extended or adjusted under 35 U.S.C. 154(b) by 238 days.

(21) Appl. No.: 14/245,243

(22) Filed: Apr. 4, 2014

(65) Prior Publication Data

US 2015/0233159 A1 Aug. 20, 2015

(30) Foreign Application Priority Data

Feb. 18, 2014 (EP) ..... 14155507

(51) Int. Cl.
*E05C 19/12* (2006.01)
*E05C 19/10* (2006.01)
*E05C 3/12* (2006.01)
(Continued)

(52) U.S. Cl.
CPC ..... *E05C 19/10* (2013.01); *E05C 19/12* (2013.01); *E05B 65/52* (2013.01); *E05C 3/12* (2013.01); *E05C 19/14* (2013.01); *Y10T 292/0945* (2015.04)

(58) Field of Classification Search
CPC ..... E05C 19/10; E05C 19/105; E05C 5/02; E05C 19/14; E05C 3/12; E05C 19/12; E05C 19/145; E05B 17/0025; E05B 15/0053; E05B 65/52; E05B 65/523; E05B 65/5269; Y10S 292/49; Y10T 292/0945
USPC ..... 292/63, 64, 65, 109, 111, 57–62, 69, 292/110, DIG. 49
See application file for complete search history.

(56) References Cited

U.S. PATENT DOCUMENTS 2,798,371 A * 7/1957 Gehrie ..... E05C 19/14 70/73
3,698,753 A * 10/1972 Atkinson ..... E05C 19/14 292/247

(Continued)

FOREIGN PATENT DOCUMENTS

DE 102006014431 * 10/2007 ..... E05B 17/0025
DE 102006025266 * 12/2007 ..... E05C 19/10

(Continued)

*Primary Examiner* — Carlos Lugo
*Assistant Examiner* — Christine M Mills
(74) *Attorney, Agent, or Firm* — Muncy, Geissler, Olds & Lowe, P.C.

(57) ABSTRACT

A case latch assembly, comprises:

Figure 1:
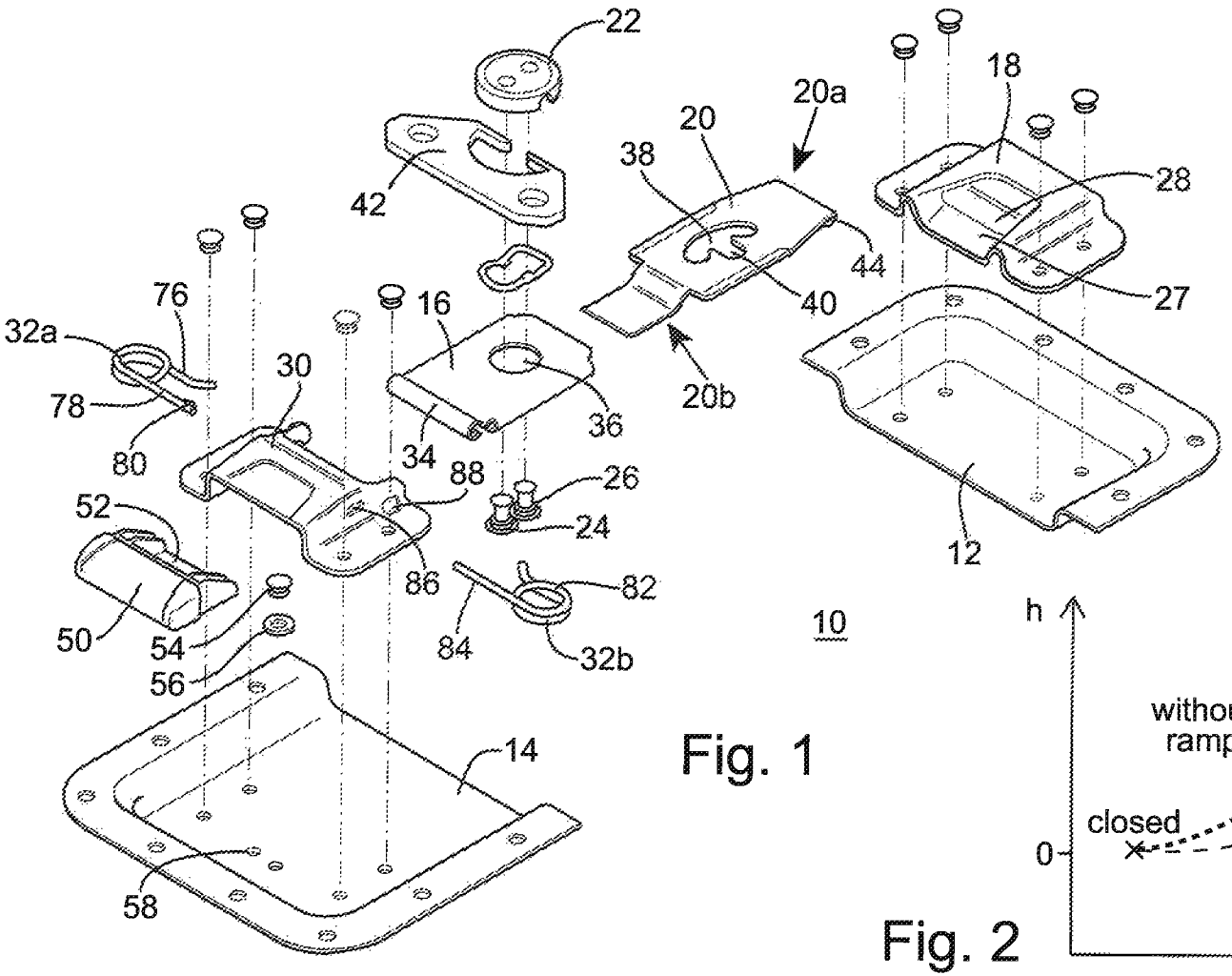

a strike plate member provided on a first lock mounting part;

a hinge member mounted on a second lock mounting part for pivotal movement about a pivot;

a reciprocating element mounted for reciprocal movement on the hinge member, the reciprocating element comprising a strike plate engagement portion to a side of the pivot nearest to the first lock mounting part for engaging with the strike plate member, and a cantilever portion which extends to the side of the pivot furthest from the first lock mounting part; and a torsion element being arranged to apply torsion to the hinge member to bias the strike plate engagement portion away from the strike plate member;

wherein, as the reciprocating element moves between a first position and a second position, the cantilever portion interacts with a constraining formation on the second lock mounting part to offset the bias applied by the torsion element to cause the strike plate engagement portion to be deflected towards the strike plate member.

13 Claims, 2 Drawing Sheets

(51) Int. Cl.
*E05C 19/14* (2006.01)
*E05B 65/52* (2006.01)

(56) References Cited

U.S. PATENT DOCUMENTS 4,326,739 A * 4/1982 Schlueter ..... E05C 19/14 292/247
4,627,650 A * 12/1986 Hauschulte ..... E05C 19/14 292/113
4,638,649 A * 1/1987 Chao ..... E05B 65/5269 292/207
4,679,833 A * 7/1987 Dueringer ..... E05B 65/52 292/113
5,511,834 A 4/1996 Willems
8,733,803 B2 * 5/2014 Drumm ..... E05C 19/10 292/114
9,103,145 B2 * 8/2015 Hatton ..... E05C 19/105
2002/0149208 A1 * 10/2002 Zamberg ..... E05C 19/105 292/98
2009/0295175 A1 * 12/2009 Hatton ..... E05B 17/0025 292/203
2014/0042755 A1 * 2/2014 Goodman ..... E05C 19/105 292/65

FOREIGN PATENT DOCUMENTS

EP 1 840 307 A2 10/2007
EP 1 975 354 A1 10/2008
EP 2 508 701 A1 10/2012
KR 101299634 B1 * 8/2013 ..... E05B 17/0045

* cited by examiner

CASE LATCH ASSEMBLY

The present invention relates to a case latch assembly.

Case latches for securing the lid and body of a case together are well known and typically comprise first and second parts of a split dish, each part being externally mounted respectively on the body and lid of a case. The first part is typically provided with a rotatably mounted hinge plate comprising a slider element moveably mounted on the hinge plate. The slider element comprises a latch hook and is arranged to move by means of an actuator. A catch plate is provided on the second part of the split dish, and the latch hook is adapted to hook onto the catch plate, and hold the case closed. To open the latch, the actuator is operated by a user to move the latch hook out of engagement with the catch plate, and the hinge plate may then be rotated by the user so that the latch hook is swung up and away from the catch plate to allow the case to be opened.

According to an aspect of the present invention, there is provided a case latch assembly, comprising:

a strike plate member provided on a first lock mounting part;

a hinge member mounted on a second lock mounting part for pivotal movement about a pivot;

a reciprocating element mounted for reciprocal movement on the hinge member, the reciprocating element comprising a strike plate engagement portion to a side of the pivot nearest to the first lock mounting part for engaging with the strike plate member, and a cantilever portion which extends to the side of the pivot furthest from the first lock mounting part; and a torsion element being arranged to apply torsion to the hinge member to bias the strike plate engagement portion away from the strike plate member;

wherein, as the reciprocating element moves between a first position and a second position, the cantilever portion interacts with a constraining formation on the second lock mounting part to offset the bias applied by the torsion element to cause the strike plate engagement portion to be deflected towards the strike plate member.

The interaction between the cantilever portion of the reciprocating element and the constraining formation effectively controls the movement profile or path followed by the strike plate engagement portion as the reciprocating member is retracted and extended on the hinge member. The movement path for the engagement portion to engage with and disengage from the strike plate member can therefore be defined by the shape and configuration of the cantilever portion of the reciprocating element and the constraining formation. The first position is preferably further from the pivot than the second position, such that the engagement portion moves into engagement with the strike plate member when the reciprocating element is retracted and disengages from the strike plate member when the reciprocating element is extended. Furthermore, due to the bias provided by the torsion element, when the strike plate engagement portion is generally in the open position a user may override the bias such that the strike plate engagement portion engages the strike plate member even when the cantilever and/or constraining formation fail, or when the first lock mounting part is spaced apart from the second lock mounting part.

The constraining formation may be provided to the side of the pivot furthest from the first lock mounting part.

When the reciprocating element moves in a first direction between the first position and the second position, the constraining formation may cause the cantilever portion to pivot in a first rotational direction up and away from the second lock mounting part, and consequently the strike plate engagement portion to pivot in the first rotational direction down and towards the strike plate member. Then, when the reciprocating element moves in a second direction opposite to the first direction between the first position and the second position, the constraining formation may cause the cantilever portion to pivot in a second rotational direction opposite to the first rotational direction down and towards the second lock mounting part and consequently the strike plate engagement portion to pivot in the second rotational direction up and away from the strike plate member.

The torsion applied by the torsion element urges the cantilever portion against the constraining formation, and as the reciprocating element moves between the first position and the second position, the cantilever portion slides along the constraining formation.

While the constraining formation may be a flat inside surface of the second lock mounting part, preferably the constraining formation comprises a ramp. As the cantilever portion climbs up the ramp, the hinge member is caused to pivot against the bias to rotate the strike plate engagement portion towards the strike plate member. Similarly, as the cantilever portion drops down the ramp, the hinge member is caused to pivot under the bias to rotate the strike plate engagement portion away from the strike plate member. Preferably, the ramp forms an inside surface of a ramp insert.

In one embodiment, the constraining formation comprises a rivet. The rivet may be provided instead of a ramp. Alternatively, a ramp may be provided as described above, and may be secured in place with a rivet. In the latter case, the rivet may be positioned and shaped to define a constraining formation against which the cantilever portion can interact in the event that the ramp should fail. In other words, a rivet used to secure the ramp in place may also act as a back-up ramp should the ramp itself fail.

One of the cantilever portion and the constraining formation may comprise a protrusion and the other comprise a depression, the protrusion engaging with the depression when the case latch assembly is in a closed position. The engagement between the protrusion and the depression advantageously inhibits the reciprocating member from sliding away from the closed position, and also provides the user with positive feedback (noise and/or vibration) indicating that the latch has reached the fully closed position.

The constraining formation may comprise a first planar surface at a first elevation, against which the cantilever portion rests when the reciprocating element is at the first position. The constraining formation may comprise a second planar surface at a second elevation, against which the cantilever portion rests when the reciprocating element is at the second position. The constraining formation may comprise a curved or planar sloped surface which joins the first and second planar surfaces, and over which the cantilever portion is required to travel when the reciprocating element moves between the first and second positions.

The strike plate engagement portion and the cantilever portion of the reciprocating element are preferably formed from a single piece of material.

In an embodiment, the first and second lock mounting parts comprise respective first and second mounting dishes, the first and second mounting dishes together comprising a latch dish. This may enable the first and second mounting dishes to be received by respective recesses in a case so that the case latch assembly is mounted substantially flush with a surface of the case.

Figure 2:
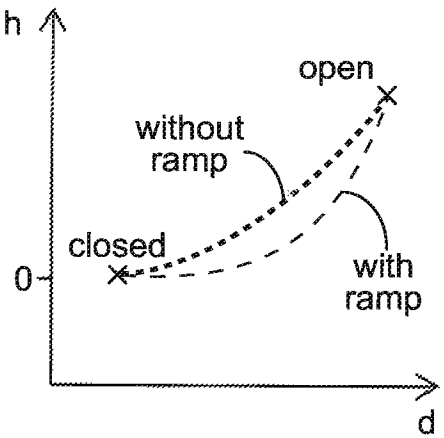
Figure 4A:
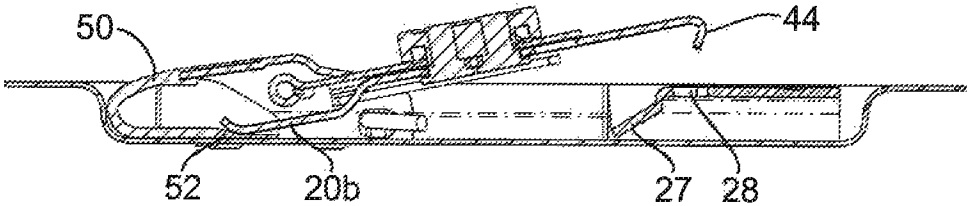
Figure 4B:
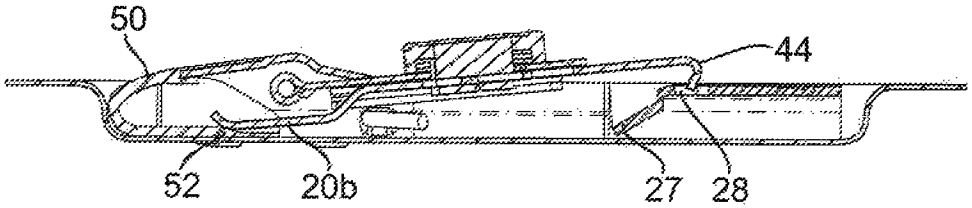
Figure 4C:
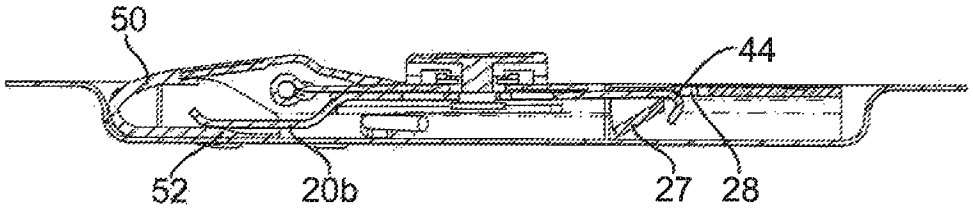
Figure 4D:
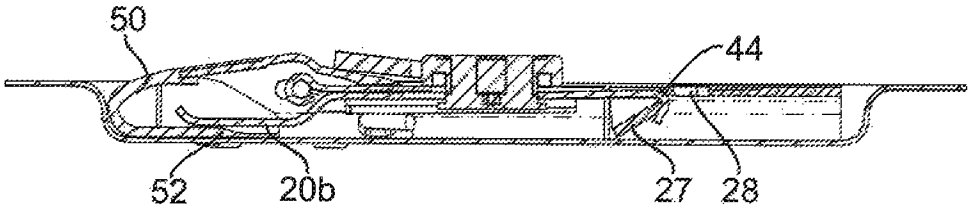
Figure 5:
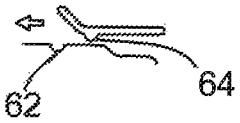
Figure 3:
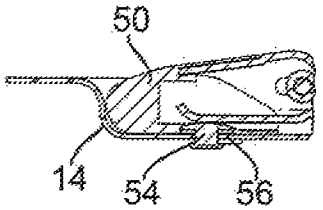

Embodiments of the invention will now be described in detail, by way of example only, with reference to the accompanying drawings, in which:

FIG. 1 is a diagrammatic exploded view of a case latch assembly according to an embodiment of the invention;

FIG. 2 schematically illustrates the movement path of a hook both when a ramp insert is used and when a ramp insert is not used in the embodiment of FIG. 1;

FIG. 3 schematically illustrates the use of a raised rivet as a back-up ramp in case of failure of the ramp insert;

FIGS. 4A to 4D schematically illustrate the case latch assembly of FIG. 1 moving from an extended position to a closed position; and FIG. 5 schematically illustrates the use of a protrusion and depression combination to provide for positive engagement when the case latch assembly is in the closed position.

Referring to FIG. 1 an embodiment of the invention provides a case latch assembly 10 comprising a first lock mounting part 12, a second lock mounting part 14, a hinge member 16, a strike plate member 18, a reciprocating element 20, a lock nut 22, acorn pin 24 and a coupling pin 26. The reciprocating element 20 comprises a strike plate engagement portion 20*a* and a cantilever portion 20*b*.

The first 12 and second 14 lock mounting parts comprise respective first and second mounting dishes. The mounting dishes 12, 14 together form a latch dish and are arranged to be respectively located on the lid and body of a case. Each mounting dish 12, 14 is arranged to be located in a respective aperture (not shown) in the case (not shown) so that the mounting dishes 12, 14 may be mounted substantially flush with a surface of the case.

The strike plate member 18 is mounted on the first mounting dish 12 and defines a strike plate aperture 28. The strike plate member 18 further comprises a strike plate ramp 27 provided at an edge of the strike plate member 18 substantially facing the strike plate engagement portion 20*a* of the reciprocating element 20.

The case latch 10 further comprises a mounting element 30. The mounting element 30 is provided on the second mounting dish 14 and is configured to receive a pair of mounting springs 32*a*, 32*b*. The hinge member 16 is mounted for pivotable movement on the springs 32*a*, 32*b*. The springs 32*a*, 32*b* are configured to apply tension to the hinge member 16 to thereby bias the strike plate engagement portion 20*a* of the reciprocating element 20 away from the strike plate member 18 when the case latch 10 is in an open position. This bias can be overcome either by the cantilever assisted process described below, or by the user manually pressing down on the reciprocating element 20. The hinge member 16 is provided with a mounting hook 34 at one end and a circular retaining aperture 36. The cam pin 24 and the coupling pin 26 are located through the retaining aperture which constrains their movement. The mounting hook 34 is located around the mounting springs 32 such that the hinge member 16 is mounted for pivotable movement.

The first 32*a* and second 32*b* mounting springs may, in other embodiments, be replaced with any other torsion elements capable of biasing the strike plate engagement portion 20*a* of the reciprocating element 20 away from the strike plate member 18. In the present embodiment, the first spring 32*a* comprises a first fixing part 76 and a first hinge mounting part 78. The first spring further comprises a key element 80 provided on the first hinge mounting part. In this example, the key element 80 comprises a tab extending generally outwardly from the first hinge mounting part 78. The second spring 32*b* comprises a second fixing part 82 and a second hinge mounting part 84.

In this example, the mounting element 30 comprises first (not shown) and second 86 mounting apertures, and first (not shown) and second 88 fixing apertures. The first and second fixing apertures are arranged to receive and couple the respective first 76 and second 82 fixing parts such that the first 32*a* and second 32*b* torsion springs form a spaced pair oppositely located about the mounting element 30. The first 78 and second 84 hinge mounting parts are provided through the respective first and second 86 mounting apertures substantially towards each other such that together they form a hinge mount (not shown). The mounting hook 34 defines an engagement slot (not shown) and the hinge member 16 is mounted on the hinge mount with the mounting hook closely receiving and substantially coupling with the hinge mount such that the tab 80 is engaged with the engagement slot. The mounting hook 34 enables the hinge member 16 to be both coupled to the torsion springs 32*a*, 32*b* and to provide engagement of the hinge member 16 with the tab 80 through a single element.

The first 32*a* and second 32*b* torsion springs are each arranged to provide a torsion biasing force to bias the hinge body 16 substantially away from the second mounting dish 14. The tab 80 is arranged to provide additional transfer of torsional force from the first torsion spring 32*a* to the hinge body 16 and is arranged to bias the hinge body away from the second mounting dish 14. It will be appreciated that in a different embodiment the angle of the tab 80 with respect to the mounting hook 34 may be altered to transfer a different amount of torsional force to the hinge body 16. In this example, the second torsion spring 32*b* does not comprise a tab but it will be appreciated that in a different embodiment it may comprise a tab.

The reciprocating element 20 is mounted for reciprocal linear movement on the hinge member 16. The reciprocating element 20 has a coupling slot 38 and a cam slot 40 provided in it. The coupling slot 38 extends generally lengthways and the cam slot 40 extends generally crossways. The coupling slot has a curved shape, to more closely match the curved path of the coupling pin 26 during actuation of the case latch. The curved shape may constrain the path of the coupling pin without interfering with the motion of the reciprocating element 20, which may ensure smooth movement of the strike plate engagement portion 20*a* between the closed and extended positions. The cam slot 40 extends generally from the central region of the coupling slot 38. The coupling slot 38 and the cam slot 40 are provided together as a single generally mushroom-shaped slot. The strike plate engagement portion 20*a* of the reciprocating element 20 is provided with a strike plate hook 44. The hook 44 is configured to engage the strike plate member 18, through its aperture 28, when the case latch is in a closed, locked position.

Referring again to the torsion springs 32*a*, 32*b*, in addition to applying the torsional bias, the coupling of the hinge member 16 to the mounting element 30 via the torsion springs 32*e*. 32*b* results in tension between the first 12 and second 14 lock mounting parts. This is because, once the hook 44 is fully engaged with the strike plate member 18, further movement of the reciprocating element 20 on the hinge member 16 deforms the springs 32*a*, 32*b* (which are the only deformable element between the hook 44 and the mounting element 30), and this deformation acts to "pull" the first 12 lock mounting part towards the second lock mounting part 14, holding them together. It also allows for a certain amount of shock absorption should the case be bumped, forcing the lid away from the body of the case.

The lock nut 22 is rotatably mounted and is provided with an actuation key 42 for manual rotation of the lock nut 22 by a user. The cam pin 24 is connected to the lock nut 22 at an off-centre position and is located through and engaged with the cam slot 40. The coupling pin 26 is connected to the lock nut 22 at a second position and is located through the coupling slot 38. Both pins 24, 26 extend through the aperture 36 in the hinge member 36.

In use, the case latch assembly 10 is operated by a user manually rotating the lock nut 22 with the actuation key 42. The rotation of the lock nut is translated by movement of the cam pin 24 within the cam slot 40 into linear movement of the reciprocating element 20 between a first position (in which the reciprocating element is extended away from the pivot) and a second position (in which the reciprocating element is retracted towards the pivot). During rotation of the lock nut 22 and the strike plate engagement member 20 the coupling pin 26 moves along the coupling slot 38.

In the extended position the coupling pin 26 is located at one end of the coupling slot 54 and the cam pin 24 is located at the end of the cam slot 56 adjacent the coupling slot 54. As the lock nut 22 is rotated the cam pin 24 is moved to the distal end of the cam slot and the position of the coupling pin 26 moves along the coupling slot to the mid-point. Further rotation of the lock nut causes the cam pin to move away from the distal end of the cam slot, back towards the coupling slot and the position of the coupling pin 26 moves further along the coupling slot towards the other end. In the closed position the cam pin 24 is back at its starting position within the cam slot 56, adjacent the coupling slot 54, and the coupling pin is located at the opposite end of the coupling slot to where it started.

While the present embodiment uses a particular cam based actuator to control the linear position of the reciprocating element 20, it will be appreciated that other structures for controlling the linear position of the reciprocating element 20 could be used instead.

The case latch assembly 10 is further provided with a number of fixing rivets 46.

The reciprocating element 20 is reciprocally linearly moveable between a closed position in which the strike plate hook 44 may engage with the strike plate member 18, through the strike plate aperture 28, and an open position in which the strike plate hook 44 is separated from the strike plate member 18. When the reciprocating element 20 is in the closed position and the strike plate hook 44 is engaged with the strike plate member 18, the first 12 and second 14 mounting dishes are brought into a generally adjacent arrangement and are locked together.

The reciprocating element 20 further comprises a cantilever portion 20*b* such that the cantilever portion extends towards the second mounting dish 14. The cantilever portion 20*b* extends away from the main body of the reciprocating element 20 in a direction generally towards the second mounting dish 14 and away from the strike plate hook 44. The cantilever portion 20*b* defines a first sloped part which is angled away from the main, planar, region of the reciprocating element 20 towards the second mounting dish 14, a second planar part which is substantially parallel to the main, planar, region of the reciprocating element 20, and a third sloped part which is angled away from the second mounting dish 14 back towards the plane of the main body of the reciprocating element 20. The first sloped part of the cantilever portion 20*b*

A ramp insert 50 is provided which is fixed to the second lock mounting part 14 by a fixing rivet 54 and a stud (not shown) on the base of the ramp insert 50 which engages with the hole 58 of the second lock mounting part 14. The ramp insert 50 is also trapped in place by the mounting element 30 when the mounting element 30 is fixed to the second lock mounting part 14. The ramp insert 50 provides a ramp 52 defining a constraining formation over which a part of the cantilever portion 20*b* of the reciprocating element 20 moves, as well as providing a protective end cap for the mounting element 30. While most components of the case latch assembly 10 may typically be made of metal, the ramp insert 50 is typically made of plastic. This results is a quieter and smoother operation as the case latch assembly 10 is opened and closed and the cantilever portion 20*b* of the reciprocating element 20 moves against the ramp 52. One problem with the plastic insert is that it may perish, or wear more quickly than the metal components which form the majority of the case latch assembly. It will be appreciated that if the ramp insert 50 fails then the latch may not close properly. In order to address this problem and permit the latch to continue to function adequately if the ramp insert 50 should fail, the rivet 54 which serves to secure the ramp insert 50 in place is shaped and positioned to act as a ramp in the event that the ramp insert 50 fails. A washer 56 raises the rivet 54 to the correct height to achieve this function. In some examples, one or more rivets alone might be used rather than employing a plastic ramp.

The cantilever portion 20*b* and the ramp 52 are arranged such that as the reciprocating element 20 is retracted on the hinge member 16 towards the closed position, the cantilever portion 20*b* rides up the ramp 52 and acts against the torsional bias provided by the springs 32*a*, 32*b*, causing rotation of the hinge member 16 and resultingly the reciprocating member 20 about the mounting hook (pivot) 34, and thus the strike plate engagement portion 20*a* to deflect (rotate) down towards the strike plate member 18.

Similarly, when the reciprocating element 20 is extended on the hinge member 16 towards the open position, the cantilever portion 20*b* drops down the ramp 52, permitting the torsion applied by the springs 32*a*, 32*b* to rotate the hinge member 16 and resultingly the reciprocating member 20 about the mounting hook (pivot) 34, and thus the strike plate engagement portion 20*a* to move up and away from the strike plate member 18.

It will be appreciated that the path of movement (movement profile) of the strike plate engagement portion and specifically the hook 44 can effectively be specified by selecting the shape and/or position of the cantilever portion 20*b* and/or the ramp 52.

In the example of FIG. 1, the first sloped part of the cantilever portion 20*b* projects down towards the constraining formation, and bypasses the pivot structure. In principle the cantilever portion 20*b* could extend closer to the same plane as the main body of the reciprocating element 20, but this would require the constraining formation to be provided at a more elevated position with respect to the base of the second lock mounting part. The second, planar part provides for a relatively long surface for engaging with the top of the ramp—which the second planar part is travelling along the top of the ramp the hook 44 will be retracted to engage with the strike plate member without there being a substantial change to the rotational position of the hinge member. The third sloped part is angled upwards to engage with and smoothly ride up and down the ramp.

The cantilever portion 20*b* is arranged such that it is substantially at the top of the ramp 52 when the strike plate engagement portion 20*b* is in engagement with the strike plate member 18. The cantilever portion 20*b* is further arranged such that when the reciprocating element 20 is moved from the closed position towards the open position the cantilever portion 20*b* descends the ramp 52 to allow the torsion applied by the torsion springs 32*a*, 32*b* to bias the strike plate engagement member away from the second mounting dish 14.

The cantilever portion 20*b* of the reciprocating element 20 extends behind the pivot point of the springs 32*a*, 32*b* and the mounting hook 34. Similarly, the ramp insert 50 is provided substantially behind the pivot point of the springs 32*a*, 32*b* and the mounting hook 34. In other words, the cantilever portion 20*b* (and preferably, if present, the ramp) extends to the side of the pivot furthest from the first lock mounting part. By providing these structures behind the hinge member 16 and the main bulk of the reciprocating element 20 and the cam-based actuation structure (rather than underneath them) the case latch assembly can have a slimmer profile.

FIG. 2 schematically illustrates the difference in the movement path of the hook 44 between the open and closed positions for each of a case where a ramp is provided, and a case in which an internal planar surface of the second lock mounting part 14 is used as the constraining formation. The vertical axis, h, represents the height of the hook 44 above the aperture 28. The horizontal axis, d, represents the travel of the reciprocating element 20 between the closed and open positions. As can be seen from FIG. 2, the provision of a ramp to engage with the cantilever portion provides a steeper curve near the open position. This is due to the change in height of the hook being accelerated as the cantilever portion rides up or drops down the slope of the ramp. This means that the hook 44 moves into the aperture 28 at a steeper angle than would be the case without a ramp, permitting a smaller aperture to be used. It will therefore be appreciated that embodiments of the present invention could be used without a ramp, relying instead on the inside planar surface of the second lock mounting part 14 (or a planar surface affixed to the inside of the second lock mounting part 14), but that it is preferable to use the cantilever portion 20*b* in combination with a ramp.

FIG. 3 schematically illustrates how the ramp insert 50 is fixed to the base of the second locking mounting part 14 using the rivet 54 and the washer 56 which raises the rivet to the correct height. It can be seen from FIG. 3 that the top surface of the rivet is similar to the slope of the ramp 52, so that the rivet 54 can perform the function of a back-up ramp to the ramp 52 should the plastic ramp insert 50 fail.

FIGS. 4A to 4D schematically illustrate the operation of the case latch assembly 10 when assembled, and when the lock nut 22 is turned with the actuation key 42. In particular, FIGS. 4A to 4D illustrate movement of the reciprocating elements 20 from the extended position (FIG. 4A) through intermediate positions (FIGS. 4B and 4C) to the closed position (FIG. 4D).

Referring first to FIG. 4A, in which the latch is fully open, it can be seen that the reciprocating element 20 is fully extended with the hook 44 overshooting the strike plate aperture 28. The cantilever portion 20*b* is positioned at the bottom part of the ramp 52. The spring bias provided by the springs 32*a*, 32*b* biases the engagement portion 20*a* of the latch up and away from the strike plate 18, and causes the cantilever portion 20*b* to be urged against the bottom part of the ramp. It will be appreciated that the extent to which the engagement portion 20*a* is biased upwards is limited by contact between the cantilever portion 20*b* and the ramp.

In FIG. 4B, the latch has started to close. The hook 44 is now aligned with the strike plate aperture 28. The reciprocating element is ¼ retracted (¾ open). As the reciprocating element moves backwards, the cantilever portion 20*b* rides up the ramp 52, overcoming the spring bias to cause the engagement portion 20*a* to move down towards the strike plate 18 and the hook 44 to descend through the strike plate aperture 28.

In FIG. 4C, the latch is continuing to close. The reciprocating element is ½ retracted. The cantilever portion 20*b* has now moved up the slope of the ramp and onto a plateau at the top. As the cantilever portion 20*b* reaches the top of the ramp, the engagement portion descends to meet the strike plate 18, and the hook 44 enters fully into the aperture 28. As the cantilever portion 20*b* moves across the plateau of the ramp, the engagement portion 20*a* continues to retract to fully engage the hook 44 with the rear of the strike plate ramp of the catch plate.

In FIG. 4D, the latch is now fully closed. The reciprocating element is fully retracted and the hook 44 is fully engaged with the catch plate, preventing the two halves of the latch from separating.

To open the latch, the reverse process occurs. In particular, as the reciprocating element is extended from its position in FIG. 4D, the hook 44 disengages from the strike plate (FIG. 4C), then lifts up out of the aperture (FIG. 4B) when the cantilever portion 20*b* starts to descend the slope of the ramp 52 and the bias applied by the springs 32*a*, 32*b* causes the hinge member 16 and the reciprocating element 20 to rotate such that the engagement portion 20*a* starts to lift away from the strike plate. Once the cantilever portion 20*b* has fully descended the ramp the latch is fully open as shown in FIG. 4A.

Referring to FIG. 5, the plateau portion of the ramp 52 is shown to comprise a depression 62, and the planar portion of the cantilever portion 20*b* is shown to comprise a protrusion 64. When the reciprocating element 20 is retracted sufficiently, the protrusion 64 drops into and engages with the depression 62. This provides positive engagement between the cantilever portion 20*b* and the ramp 52 to inhibit the reciprocating portion from inadvertently moving back towards the open position. Additionally, the action of the protrusion 64 dropping into the depression 62 may provide physical feedback of engagement which is discernable by the user. It will be appreciated that, while the protrusion is shown on the cantilever portion 20*b* and the depression 62 is shown on the ramp 52, a protrusion could instead be provided on the ramp and a depression on the cantilever portion 20*b*. A plurality of depressions and protrusions could be provided. The protrusion could be in the form of a ridge and the depression in the form of a channel, or the protrusion could be in the form of a stud and the depression in the form of a pit. A similar depression (or protrusion) could be provided at the bottom of the ramp, to provide positive engagement and engagement feedback when the latch is in the fully open position.

The invention claimed is:

1. A case latch assembly, comprising:

a strike plate member (18) provided on a first lock mounting part (12);

a hinge member (16) mounted on a second lock mounting part (14) for pivotal movement about a pivot;

a reciprocating element (20) mounted for reciprocal movement on the hinge member (16), the reciprocating element (20) comprising a strike plate engagement portion (20*a*) to a side of the pivot nearest to the first lock mounting part (12) for engaging with the strike plate member (18), and a cantilever portion (20*b*) which extends to the side of the pivot furthest from the first lock mounting part (12); and a torsion element (32*a*, 32*b*) being arranged to apply torsion to the hinge member (16) to bias the strike plate engagement portion (20*a*) away from the strike plate member (18);

wherein, as the reciprocating element (20) moves between a first position and a second position, the cantilever portion (20*b*) interacts with a constraining formation (52) on the second lock mounting part (14) to offset the bias applied by the torsion element (32*a*, 32*b*) to cause the strike plate engagement portion (20*a*) to be deflected towards the strike plate member (18);

wherein the constraining formation (52) comprises a ramp;

wherein as the cantilever portion (20*b*) climbs UP the ramp, the hinge member (16) is caused to pivot against the bias to rotate the strike plate engagement portion (20*a*) towards the strike plate member (18); and wherein the ramp is secured in place with a rivet (54), and the rivet (54) is positioned and shaped to define a constraining formation against which the cantilever portion (20*b*) can interact in the event that the ramp (52) should fail.

2. A case latch assembly according to claim 1, wherein the first position is further from the pivot than the second position.

3. A case latch assembly according to claim 1, wherein, when the reciprocating element (20) moves between the first position and the second position, the constraining formation (52) causes the cantilever portion (20*b*) to pivot in a first rotational direction up and away from the second lock mounting part (14), and consequently the strike plate engagement portion (20*a*) to pivot in the first rotational direction down and towards the strike plate member (18).

4. A case latch assembly according to claim 1, wherein the torsion applied by the torsion element (32*a*, 32*b*) urges the cantilever portion (20*b*) against the constraining formation (52), and as the reciprocating element (20) moves between the first position and the second position, the cantilever portion (20*b*) slides' along the constraining formation (52).

5. A case latch assembly according to claim 1, wherein the ramp forms an inside surface of a ramp insert (50).

6. A case latch assembly according to claim 1, wherein one of the cantilever portion (20*b*) and the constraining formation (52) comprises a protrusion (64) and the other comprises a depression (62), the protrusion (64) engaging with the depression (62) when the case latch assembly is in a closed position.

7. A case latch assembly according to claim 1, wherein the constraining formation (52) comprises a first planar surface at a first elevation, against which the cantilever portion (20*b*) rests when the reciprocating element (20) is at the first position.

8. A case latch assembly according to claim 7, wherein the constraining formation (52) comprises a second planar surface at a second elevation, against which the cantilever portion (20*b*) rests when the reciprocating element (20) is at the second position.

9. A case latch assembly according to claim 8, wherein the constraining formation (52) comprises a curved or planar sloped surface which joins the first and second planar surfaces, and over which the cantilever portion (20*b*) is required to travel when the reciprocating element moves between the first and second positions.

10. A case latch assembly according to claim 1, wherein the constraining formation (52) is provided to the side of the pivot furthest from the first lock mounting part (12).

11. A case latch assembly according to claim 1, wherein the strike plate engagement portion (20*a*) and the cantilever portion (20*b*) of the reciprocating element (20) are formed from a single piece of material.

12. A case latch assembly as claimed in claim 1, wherein the first and second lock mounting parts comprise respective first and second mounting dishes (12, 14), the first and second mounting dishes together comprising a latch dish.

13. A case latch assembly according to claim 1, wherein the constraining formation is formed by an internal surface of the second lock mounting part.

* * * * *